United States Patent [19]

Searle

[11] Patent Number: 4,714,411

[45] Date of Patent: Dec. 22, 1987

[54] FLUID PRESSURE INTENSIFIER DEVICE

[75] Inventor: Robin H. J. Searle, Yeovil, England

[73] Assignee: Normalair-Garrett (Holdings) Limited, Yeovil, England

[21] Appl. No.: 874,863

[22] Filed: Jun. 16, 1986

[30] Foreign Application Priority Data

Jun. 24, 1985 [GB] United Kingdom ..... 8515944

[51] Int. Cl.[4] ..... F04B 9/08

[52] U.S. Cl. ..... 417/246; 417/266; 417/347

[58] Field of Search ..... 417/347, 244, 246, 254–268

[56] References Cited

U.S. PATENT DOCUMENTS

| | | | |
|---|---|---|---|
| 1,773,593 | 8/1930 | McLaughlin et al. | 417/246 |
| 2,479,856 | 8/1949 | Mitton | 417/266 X |
| 2,486,079 | 10/1949 | Tucker | 417/347 X |
| 2,592,940 | 4/1952 | Monoyer | 417/347 X |
| 3,022,738 | 2/1962 | Krute | 417/347 |
| 3,085,512 | 4/1963 | Alyanak et al. | 417/347 |
| 3,175,499 | 3/1965 | Varney et al. | 417/347 X |

FOREIGN PATENT DOCUMENTS

| | | | |
|---|---|---|---|
| 1599411 | 9/1981 | United Kingdom | 417/347 |

*Primary Examiner*—Carlton R. Croyle
*Assistant Examiner*—Theodore Olds
*Attorney, Agent, or Firm*—Larson and Taylor

[57] ABSTRACT

A fluid pressure intensifier device particularly suited for intensifying the pressure of a gas has a plurality of piston and cylinder compression stages of sequentially reducing volume connected by flow passages (FIG. 5*b*) for conducting fluid to be pressure intensified sequentially through the compression stages. Individual pressure fluid powered driving mechanisms for each piston or cylinder compression stage comprise driving piston and cylinder assemblies controlled to operate in sequence by a rotatable port plate. The port plate is rotatable by a positive displacement pressure fluid motor actuated by the pressure fluid powering the driving piston and cylinder assemblies, the outer gear of the motor being constituted by the rotatable port plate.

6 Claims, 6 Drawing Figures

FLUID PRESSURE INTENSIFIER DEVICE

BACKGROUND OF THE INVENTION

1. Field of the Invention

This invention relates to a fluid pressure intensifier device and more particularly, although not exclusively, to a device for intensifying gas pressure.

2. Description of the Prior Art

Compressed air stored in a pressure vessel finds particular use for power and control in systems that require a short burst of high level power, especially when the system requires stored energy. For high release rates, an air accumulator is an order of magnitude lighter than electric batteries, and much lighter than an hydraulic accumulator. Furthermore, the air operated system can operate over a much wider range of hot and cold temperatures.

Thus, compressed air may find a number of uses in aircraft applications including, for example, operation of brakes and landing gear, whilst being particularly useful for starting engines or auxiliary power units because this operation requires stored energy, high power level and cold operation.

Pressurised nitrogen is frequently used in a nitrogen inerting system to pressurise aircraft fuel tanks and, in modern day aircraft, the nitrogen source may be low pressure nitrogen delivered by a molecular sieve type gas separation system and subsequently pressure intensified.

Similarly, oxygen-enriched air for breathing by aircrew is now frequently supplied by a molecular sieve gas separation system which delivers the oxygen-enriched air at low pressure so that pressure intensification may be a requirement.

There is a requirement, therefore, in aircraft and in other applications, for a compressor or pressure intensifier device suitable for intensifying the pressure of a range of gases including air.

Most of the air compressors or pressure intensifier devices presently available are old in design and do not meet the requirements of modern aircraft with respect to life, reliability and weight. There is a clear need for an improved pressure intensifier device capable of satisfying the potential applications hereinbefore mentioned.

U.S. Pat. No. 4,516,913 discloses a multi-stage drum compressor having a plurality of piston and cylinder stages of different volume angularly spaced at locations around a longitudinal axis of the drum. The first piston and cylinder stage has the largest volume and subsequent stages are of decreasing volume with the last stage having the smallest volume. The stages are interconnected by passages provided in the drum for conducting gas to be compressed sequentially to each of the stages. The pistons of the stages are actuated by a shaft driven swash plate. This mechanism is a source of significant wear and tear because it functions to transfer forces from the rotating shaft to the pistons, and from one piston to another. Also, because the cylinder side walls are marginally lubricated, piston side loads are particularly troublesome causing premature wear-out.

SUMMARY OF THE INVENTION

It is an object of the present invention to provide an improved fluid pressure intensifier device which is suitable for intensifying the pressure of a gas and particularly suited for use in an aircraft application.

According to the invention a fluid pressure intensifier device comprising a plurality of piston and cylinder compression stages of sequentially decreasing volume, flow passages for conducting fluid to be pressure intensified sequentially through said stages, and means for operating said stages in sequence to effect stagewise pressure intensification of the fluid, is characterised in that said operating means comprise an individual pressure fluid powered driving mechanism for each said piston and cylinder compression stage, and control means for causing said driving mechanism to operate in said sequence.

Each driving mechanism may comprise a driving piston and cylinder assembly integrated with its associated compression stage. For compactness, the piston and cylinder compression stages may be arranged in a circle about an axis and the control means may comprise a port plate rotatable about the axis and controlling pressure fluid inlet and outlet connections to the driving piston and cylinder assemblies. The axes of the piston and cylinder compression stages may be parallel to the axis about which they are arranged or they may extend radially therefrom.

In a preferred embodiment of the invention, the rotatable port plate is rotatable by a positive displacement pressure fluid motor actuated by the pressure fluid powering the driving piston and cylinder assemblies.

The positive displacement motor may comprise a gerotor motor the outer gear of which is constituted by the rotatable port plate.

The pressure fluid inlet and outlet connections to the driving piston and cylinder assemblies may comprise a fixed port plate.

The rotatable port plate may be positioned for operation between a driving fluid supply end cap and the fixed port plate.

The driving cylinders and the compression cylinders may be provided in a cylinder body having the driving cylinders opening at an end face of the cylinder body which locates with an end face of the fixed port plate.

Each driving cylinder may be of larger diameter than its associated compression cylinder and may constitute an extension thereof with a stepped piston reciprocable in the driving and compression stage cylinders constituting the respective driving and compression stage pistons.

A fluid pressure intensifier device in accordance with the invention may have at least two groups of compression stages, each group comprising a plurality of piston and cylinder stages of sequentially decreasing volume.

A pressure intensifier device in accordance with the invention is particularly suited to the compression of a gas such as air, nitrogen, or oxygen by an hydraulic driving fluid.

BRIEF DESCRIPTION OF THE DRAWINGS

The invention will now be further described by way of example and with reference to the accompanying drawings in which.

DETAILED DESCRIPTION OF THE INVENTION

Figure 1:
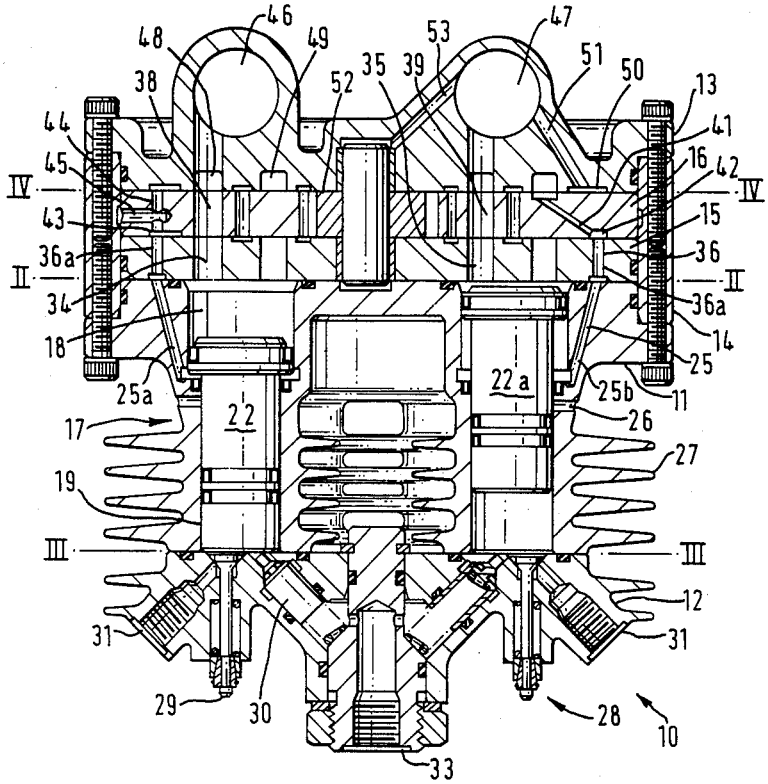
FIG. 1 is a sectional view of a fluid pressure intensifier device in accordance with one embodiment of the invention.
Figure 2:
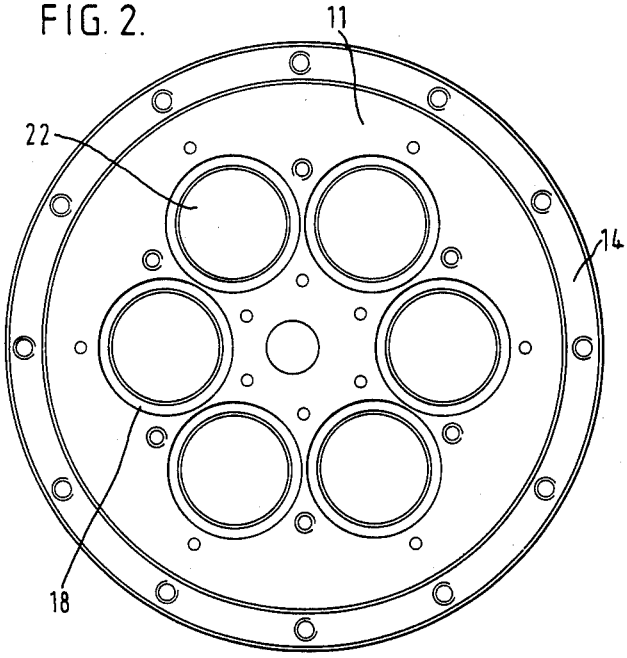
FIGS. 2, 3 and 4 are sectional views through the device of FIG. 1 on lines II II, III III and IV IV, respectively.
Figure 3:
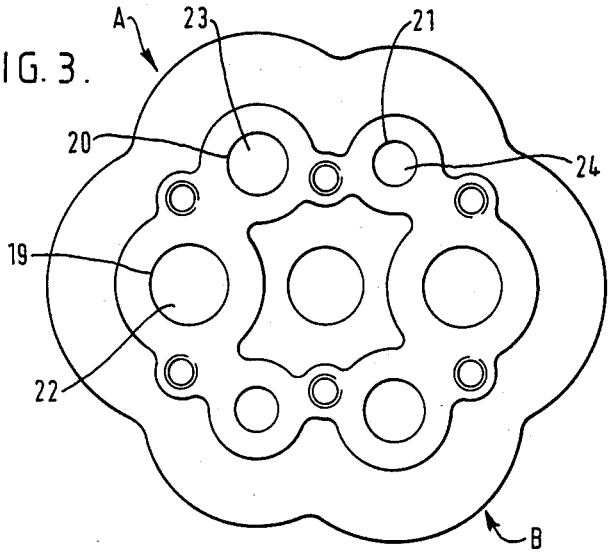

Referring to FIGS. 1, 2 and 3, a pressure intensifier device 10 comprises five principal body parts including a cylinder body 11 closed at its respective ends by a pressure intensified fluid delivery end cap 12 and a driving fluid supply end cap 13. In this embodiment the pressure intensified fluid comprises a gas, and the driving fluid comprises an hydraulic fluid. The end cap 13 is spaced from the cylinder body 11 by an annular distance piece 14 locating between corresponding flanges of the end cap 13 and the body 11. The space so defined is occupied by a fixed port plate 15 located against the hydraulic end face of the cylinder body 11 and a port plate 16 positioned for operation between the fixed port plate 15 and the end cap 13 and rotatable about a longitudinally extending central axis of the device 10.

The cylinder body 11 is provided with two groups A and B (FIG. 3) of three cylinders 17, each cylinder 17 comprising an integrated driving cylinder and compression stage cylinder. The cylinders 17 are equi-spaced around a common pitch circle and have their axes parallel to the rotational axis of the rotatable port plate 16. Each cylinder 17 has a stepped bore that passes through the cylinder body 11, major bores 18 (FIG. 2) comprising driving cylinders and being of identical dimensions with one end positioned adjacent to the fixed port plate 15. Minor bores 19, 20, 21 (FIG. 3) of the respective cylinders 17 in each group are of serially reduced diameter and volume and each have an end adjacent to the end cap 12. Three stepped pistons 22, 23, 24 (FIG. 3) are reciprocable in each of the two groups A and B of cylinders 17. An inclined fluid duct 25 connects each cylinder 17 at the underside of its major bore 18 with grooving in the face of fixed port plate 15, whilst a leakage path 26 connects ambient atmosphere with the interior of the cylinders 17 at a position intermediate the working travel of the upper and lower sealing rings of the pistons 22, 23, 24. The outsides of the barrels of the cylinders 17 are provided with cooling fins 27.

Figure 5A:
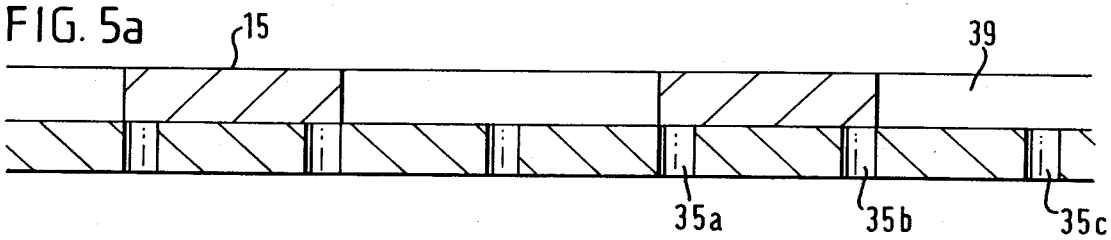
FIGS. 5*b* and 5*a* are developed sectional views of groups of cylinders of the device of FIG. 1, and of fixed and the rotatable port plates, respectively.
Figure 5B:
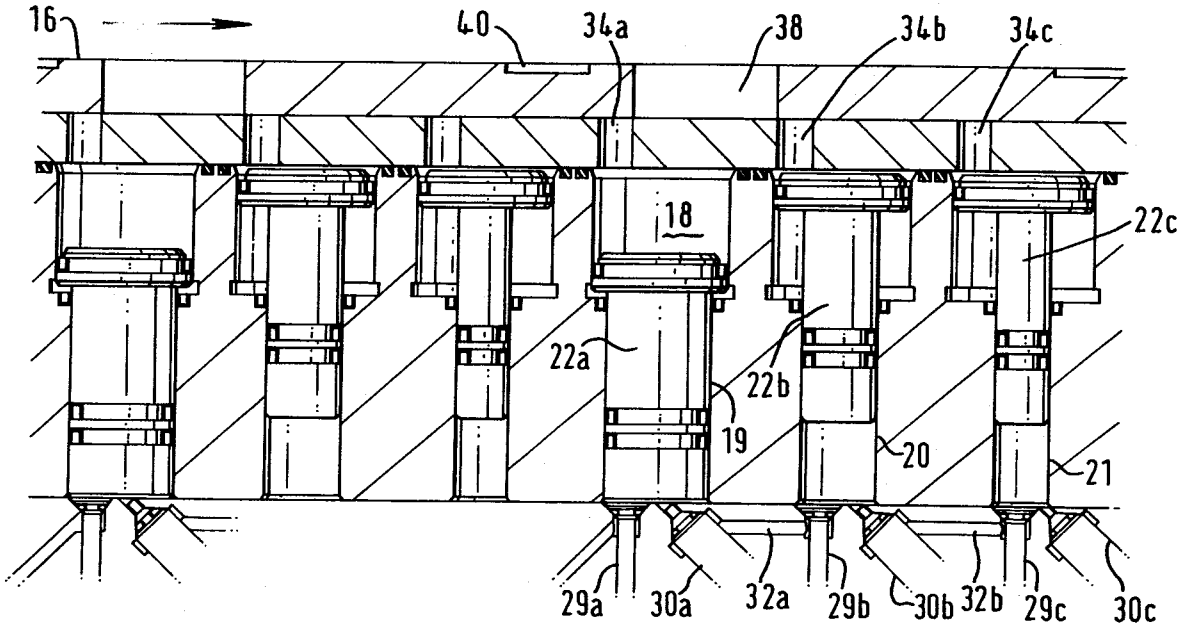

The minor bores 19, 20, 21 of the two groups A and B of cylinders 17 comprise compression stage cylinders which are closed by the end cap 12. The end cap 12 carries valve means 28 (FIG. 1) comprising an inlet and an outlet valve 29 and 30, respectively, for each compression stage cylinder or minor bore 19, 20, 21. The inlet valve 29*a* (FIG. 5*b*) of the largest, or first stage, compression cylinder in each group is positioned downstream of a gas supply inlet connection 31. The outlet valves 30 of the first and second stage compression cylinders 19, 20 each open to the inlet valve 29 of the next stage compression cylinder 20, 21, respectively, by way of individual transfer ducts 32 (FIG. 5*b*). The outlet valve 30 of the third stage compression cylinder 21 opens into a pressure intensified gas collecting chamber (not shown) and thence to a pressure intensified gas outlet connection 33.

Hydraulic fluid inlet and outlet connections to the driving piston and cylinders are provided by the fixed port plate 15 which has a set of six inlet ports 34 and a set of six outlet ports 35 equally spaced on an outer and an inner pitch circle, respectively, and radially paired for connecting hydraulic fluid supply and hydraulic fluid return to each of the major bores 18. Six smaller ports 36 are positioned radially outboard of the inlet ports 34 for connecting the fluid ducts 25 in the cylinder body to fluid supply and to fluid return.

Figure 4:
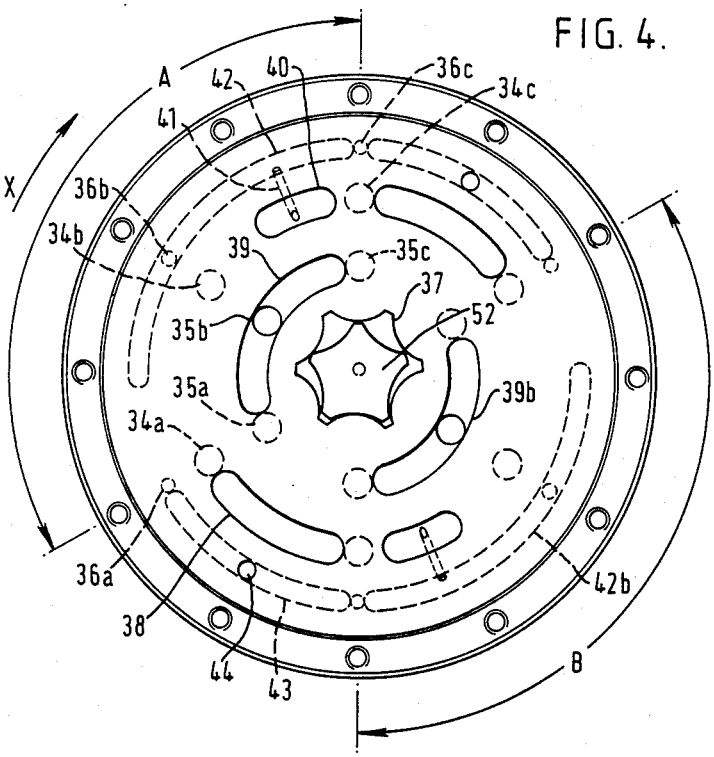

The rotatable port plate 16 provides hydraulic fluid distribution ports for the sequential operation of the pistons 22, 23, 24 in each group and oilways for lubrication of the port plate itself. It further provides, for its rotation, an internal profile 37 adapted to the form of the outer gear of a gerotor positive displacement mechanism, i.e. an internal gear lobe motor. The hydraulic fluid distribution ports include a pair of diametral arcuate inlet ports 38 and a pair of diametral arcuate outlet ports 39 positioned on pitch circle dimensions corresponding to those of the ports 34, 35, respectively, in the fixed port plate 15 (FIGS. 1 and 4). For one group of cylinders and pistons 17, say A, the positional relationship of an arcuate inlet port 38 and the companion arcuate outlet port 39 taken relative to radial pairs of inlet and outlet ports 34, 35 is such that in the direction of rotation of the port plate 16, as shown by arrow X in FIG. 4, the arcuate inlet port 38 trails the arcuate outlet port 39 and has an arcuate length matching the arcuate dimension between the near edges of two adjacent inlet ports 34*a*, 34*b* (FIG. 4), whilst the arcuate outlet port 39 has an arcuate length which matches the arcuate dimension between the near edges of two outlet ports 35*a* and 35*c* which places the intermediate outlet port 35*b* at the mid point of its arcuate length. Such proportioning of the arcuate inlet and outlet ports 38, 39 and the inlet and outlet ports 34, 35 provides that the period given for outflow through each outlet port 35 is double that given to inflow through each inlet port 34. Two diametrally arranged shallow grooves 40 are situated in the upper surface of the rotatable port plate 16 on the same pitch circle dimension as the arcuate inlet ports and (continuing the group A reference above) positioned so as to trail the arcuate inlet port 38 at a distance therefrom that is slightly greater than the diameter of an inlet port 34. Each groove 40 extends through an arc of thirty degrees and is connected by a slanting drillway 41 to an associated shallow arcuate groove 42 in the underside of the port plate 16 on a pitch circle dimension arranged to overlie that of the ports 36 in the fixed port plate 15. Each arcuate groove 42 trails an arcuate inlet port 38 by a distance corresponding to the diameter of a port 36 and extends through an arc of ninety degrees. Another pair of diametrally arranged shallow arcuate grooves 43 is provided on the underside of the rotatable port plate 16 on the same pitch circle dimension as the grooves 42 and each has fluid communication with the topside by way of a port 44. Also each groove 43 leads a groove 42 by a distance corresponding to the diameter of a port 36 and extends through an arcuate distance corresponding to that between the near edges of two adjacent ports 36. The rotatable port plate 16 has an overall diametral dimension that provides a running fit within the distance piece 14 and is provided with radial lubrication ports 45 (see FIG. 1) connecting ports 44 with the diametral periphery. A series of other ports connects the opposite surfaces of the port plate 16 to provide for balanced lubrication thereof.

The end cap 13 is provided with an hydraulic fluid supply inlet 46 and return outlet 47 which connect, respectively, with an outer and an inner annular groove 48 and 49, respectively, which overlie and provide fluid communication with the inlet and the outlet arcuate ports 38, 39 of the rotatable port plate 16 and thence the inlet and outlet ports 34, 35 of the fixed port plate 15. Another annular groove 50 is provided concentrically of the grooves 48, 49 at a pitch circle dimension according with ports 44 and grooves 43 of the rotatable port plate 16 and is connected to the return outlet 47 by a duct 51.

An inner gear member 52 which completes the gerotor is freely located within the assembled intensifier by means of its through-shaft being supported by two bearings, such as acetal resin split bush bearings, of which one is provided in a bearing housing in the fixed port plate 15 and the other in a bearing housing in the hydraulic end cap 13. A fluid delivery duct (not shown) in the end cap 13 provides for hydraulic fluid to reach and drive the gerotor, whilst return of fluid therefrom is by way of a duct 53 which connects the shaft housing in the end cap to the return outlet 47.

The five principal parts of the intensifier are secured together and sealed in known manner such as by a peripheral ring of equi-spaced set screws and by suitable seals such as face and/or toroidal types.

Operation of the fluid pressure intensifier device 10 will now be described with reference to the accompanying drawings. Assuming that the return outlet 47 is connected to 'tank' and that sources of hydraulic fluid and of gas at appropriate pressures are connected to the respective hydraulic fluid supply inlet 46 and to the two gas supply inlets 31 and, assuming also that the paired compression cylinders of the two groups of cylinders and pistons are about to commence a cycle, then the stepped piston **22*a* that is effective to compress gas in each first stage minor bore 19 (i.e. the largest and first in sequence of each group) is at its uppermost position, as seen at the right hand side in FIG. 1 whilst the rotatable port plate 16 is in a position, relative to the ports in the fixed port plate 15, as seen in FIG. 4, in which the fixed ports 34*a* and 35*a* are, respectively, the fixed inlet and outlet ports of the major bore 18** of the first stage cylinder of group A.

On the point of commencement of the cycle the rotatable port plate 16 is in a position such that all the fixed inlet ports **34*a*, 34*b*, 34*c* of the group A cylinders are occluded whilst, of the fixed outlet ports 35, only port 35*b* from the second stage and which is at the mid point position of the arcuate outlet port 39, is uncovered and port 36*a* of the first stage is on the point of being connected to arcuate groove 43, whilst port 36*b* of the second stage is connected to arcuate groove 42 and port 36*c*** of the third stage is about to be connected thereto.

Connection of a port 36 with an arcuate groove 42 allows pressurised hydraulic fluid from the supply inlet 46 to be applied to the underside of the annular shoulder or step of that piston 22 which is associated with the particular port 36 by way of annular groove 48 in the end cap 13, an arcuate groove 40 and arcuate groove 42 interconnected by a slanting drillway 41 in the rotatable port plate 16, the port 36 in the fixed port plate 15 and thence by an inclined fluid duct 25 whereby the piston can be raised and held at its topmost position. Connection of a port 36 to an arcuate groove 43 allows hydraulic fluid to be relieved to 'tank' from beneath the annular shoulder or step of a piston 22 by way of the inclined fluid duct 25, the port 36, arcuate groove 43, port 44, annular groove 50, duct 51 and the return outlet 47 so that the piston can be released from being held at its topmost position.

The rotatable port plate 16 is pressure balanced by the hydraulic fluid and driven into rotation by the effect of it as it passes from the supply inlet 46 to the return outlet 47 by way of the gerotor in which the fluid is effective on the working surfaces of the outer gear form provided by the internal profile 37 of the port plate 16 and those of the inner gear member 52.

With commencement of a cycle (considering the group A cylinders and pistons only) as the port plate 16 rotates, arcuate inlet port 38 uncovers fixed inlet port **34*a* of the first stage and simultaneously port 36*a* is connected to arcuate groove 43 and 'tank' so that piston 22*a* becomes released from its topmost position and driven downwardly to cause compression of the gas filling the first stage minor bore 19 beneath it. The compressed gas overcomes the resistance of the outlet valve 30*a* and passes to the smaller minor bore 20 of the second stage by way of the transfer duct 32*a* and inlet valve 29*b*; the piston 22*b* of the second stage being already held at its topmost position in readiness to receive a charge, owing to fixed outlet port 35*b* continuing to be uncovered by arcuate outlet port 39 and port 36*b* continuing connection to the arcuate groove 42 and supply pressure. At the same time fixed outlet port 35*c* of the third compression stage becomes uncovered and port 36*c* becomes connected to the arcuate groove 42 whereby piston 22*c* is driven upwardly, expelling hydraulic fluid from the major bore 18** to 'tank', and held in its topmost position.

Sixty degrees of rotation of the rotatable port plate 16 advances the sequence one stage so that fixed inlet port **34*b* of the second stage becomes uncovered and port 36*b* is connected to the arcuate groove 43 so that piston 22*b* is released from its topmost position and driven downwardly to compress to a second stage of compression the gas received into the second stage minor bore 20 from the first stage minor bore 19. The gas upon being compressed to a second stage pressure overcomes the resistance of the outlet valve 30*b* and passes to the third stage minor bore 21 by way of the transfer duct 32*b* and the inlet valve 29*c*. The piston 22*c* is already held at its topmost position owing to outlet port 35*c* being uncovered and port 36*c* being connected to the arcuate groove 42. At this time the fixed outlet port 35*a* of the first stage commences to be uncovered by the arcuate outlet port 39*b*, and port 36*a* commences to be connected to arcuate groove 42*b* so that the piston 22*a* is raised to its topmost position ready for entry of gas into the first stage minor bore 19** for first stage compression.

The arcuate outlet port **39*b* and the arcuate groove 42*b* having advanced from previously serving the group B cylinders and pistons, and arcuate outlet port 39 and arcuate groove 42 having correspondingly moved from the group A sector into the group B sector, a further sixty degrees of rotation of the rotatable port plate 16 advances the sequence to its final stage so that fixed inlet port 34*c* becomes uncovered and port 36*c* is connected to arcuate groove 43 whereupon piston 22*c* is released and driven downwardly, so providing final compression of the gas filling the smallest minor bore 21. The gas upon being compressed overcomes the resistance of the outlet valve 30*c* and passes to the gas collection chamber (not shown) and thence to the gas outlet connection 33 (FIG. 1) for use. The fixed outlet port 35*b* of the second stage becomes uncovered by the arcuate outlet port 39*b*, and port 36*b* becomes connected to arcuate groove 42*b* and piston 22*b* is raised to its topmost position whilst fixed outlet port 35*a* remains open and port 36*a* remains connected to 'tank' by way of arcuate groove 42*b* so continuing to hold the piston 22*a* in the topmost position in preparedness to commence a new cycle upon arrival of the other arcuate inlet port 38**.

Any gas leakage past the pistons 22 is dissipated to ambient atmosphere by way of the leakage paths 26. The sequence is thereafter repeated.

It will be appreciated that various alternatives or changes to the disclosed embodiment may be effected without departing from the scope of the invention, such as a gerotor not being the only fluid motor form that is applicable. The number of compression stages and the number of groups of cylinders and pistons may be other than shown is this disclosure.

What is claimed is:

1. In a fluid pressure intensifier device having a plurality of piston and cylinder compression stages of sequentially decreasing volume, flow passages for conducting fluid to be pressure intensified sequentially through said stages, and means for operating said stages in sequence to effect stagewise pressure intensification of fluid, the improvement comprising an individual pressure fluid powered driving mechanism for each said piston and cylinder compression stages, each of said driving mechanisms comprising a driving piston and cylinder assembly integrated with the compression stage associated therewith, said compression stages being arranged in a circle about an axis, and control means for causing said driving mechanisms to operate in sequence, said control means comprising a port plate rotatable about said axis and controlling pressure fluid inlet and outlet connections to the driving piston and cylinder assemblies, a positive displacement pressure fluid motor actuated by the pressure fluid powering said driving piston and cylinder assemblies for rotating said port plate, said positive displacement motor comprising a gerotor motor having an outer gear comprising said rotatable port plate.

2. A fluid pressure intensifier device according to claim 1, wherein said pressure fluid inlet and outlet connections to the driving piston and cylinder assemblies comprise a fixed port plate.

3. A fluid pressure intensifier device according to claim 2, wherein the rotatable port plate is positioned for operation between a driving fluid supply end cap and the fixed port plate.

4. A fluid pressure intensifier device according to claim 2, wherein the driving cylinders and the compression cylinders are provided in a cylinder body having the driving cylinders opening at an end face of the cylinder body which locates with an end face of the fixed port plate.

5. A fluid pressure intensifier device according to claims 1, wherein each said driving cylinder is of larger diameter than its associated compression stage cylinder and constitutes an extension of the latter, a stepped piston reciprocable in the driving and compression stage cylinders constituting the respective driving and compression stage pistons.

6. A fluid pressure intensifier device according to claim 1 further comprising at least two groups of compression stages, each group comprising a said plurality of piston and cylinder stages of sequentially decreasing volume.

* * * * *